United States Patent [19]

Curtiss

[11] 4,149,661

[45] Apr. 17, 1979

[54] THIMBLE HAVING A MAGNETIC RECESS

[76] Inventor: Arline Curtiss, 345 Mountain Ave., Ridgewood, N.J. 07450

[21] Appl. No.: 879,056

[22] Filed: Feb. 21, 1978

[51] Int. Cl.[2] ..... D05B 91/04

[52] U.S. Cl. ..... 223/101

[58] Field of Search ..... 223/101

[56] References Cited

U.S. PATENT DOCUMENTS

| | | | |
|---|---|---|---|
| 587,123 | 7/1897 | Holcomb | 223/101 |
| 649,310 | 5/1900 | Iles | 223/101 |
| 926,040 | 6/1909 | Weigle | 223/101 |
| 936,902 | 10/1909 | Iles | 223/101 |
| 1,301,093 | 4/1919 | Bradford | 223/101 |
| 2,536,979 | 1/1951 | Furedi | 223/101 |

FOREIGN PATENT DOCUMENTS

| | | | |
|---|---|---|---|
| 498944 | 1/1954 | Canada | 223/101 |
| 890449 | 8/1953 | Fed. Rep. of Germany | 223/101 |
| 961425 | 6/1964 | United Kingdom | 223/101 |

*Primary Examiner*—Louis Rimrodt

*Attorney, Agent, or Firm*—Donald R. Heiner

[57] ABSTRACT

A thimble having a small magnetic recess formed in the tip thereof for receiving a pin or other insertable member. The small recess may be round, square, rectangular or any other shape and may be of various outside dimensions and depth. This small recess is magnetized so that the head of a pin can be easily picked up and the pin inserted into some material. Further, the open end of the thimble can receive removable inserts for changing the size of the opening for different thumb sizes. Still another embodiment discloses the use of a thimble constructed as above but in two pieces with a spring disposed between the two sections. Finally, the entire head of the thimble may be magnetized.

2 Claims, 4 Drawing Figures

FIG. 2
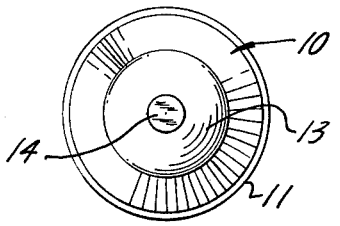
FIG. 3
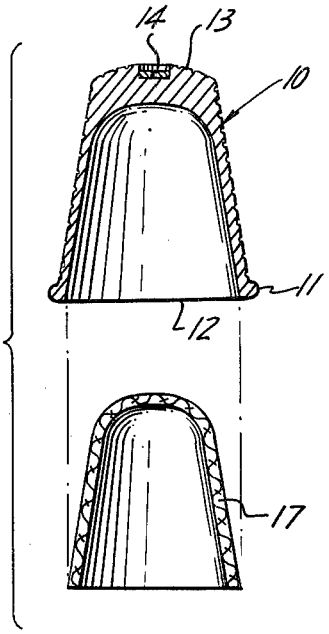
FIG. 1
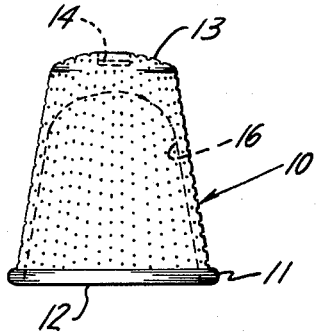
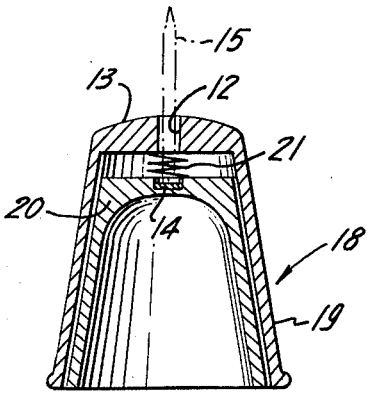
FIG. 4
FIG. 5
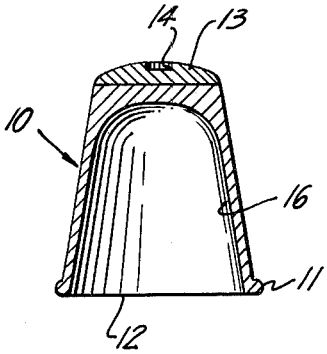

THIMBLE HAVING A MAGNETIC RECESS

BACKGROUND OF THE INVENTION

The present invention relates to the field of thimbles, more particularly used in needlepoint work or other similar arts and crafts where it is required to pick up and insert a large quantity of pins into a needlepoint form or other material while holding and stretching the material with the other hand. The thimble of the instant invention has a small magnetic recess formed in the tip thereof for receiving metal pins or other members to be inserted into some material or form. Adapters can be provided for insertion into the open end of the thimble for changing the sizes of the opening to accommodate different thumb and finger sizes. The thimble can be constructed of two shells with a spring disposed between the two sections to enable the user to easily insert a pin or other member into a needleoint form or other materal. It should be noted that the small magnetic recess may be of any shape or outside dimension or depth to accommodate pins having various shapes and head sizes.

PRIOR ART

The most pertinent prior art patents uncovered during the search appear to be the patents to Bradford, U.S. Pat. No. 1,301, 093; Chipley, U.S. Pat. No. 222,572; Beaty, U.S. Pat No. 279,524; and Furedi, U.S. Pat. No. 2,536,979.

The patent to Bradford discloses a magnetic thimble attachment which is adapted to be applied to a standard sewing thimble. This patent does not teach the magnetized recess of the instant invention, the insertable adapters, nor the spring loaded embodiment.

The patent to Chipley disloses a thimble of two-piece construction wherein the inner piece has spring holding jaws adapted to grasp the fingertip and retain the thimble thereon, without regard to the greater or less thickness of the finger. This is not a removable adapter such as taught in the instant invention nor does the patent teach a magnetized recess.

The patent to Beaty discloses a thimble constructed of three separate shells which cooperate together to form a galvanic action. Again, this patent does not teach a magnetic recess nor the adapters of the instant invention.

The patent to Furedi discloses a thimble provided with a permanent magnet. In this patent, a permanent magnet is placed inside a tip or cap which then may be affixed to the body of the thimble itself. Again, there is no showing of a magnetized recess formed in the tip of the thimble, nor does it disclose the removable adapters, nor does it teach the two-piece spring loaded construction of the instant invention.

SUMMARY OF THE INVENTION

Briefly, the invention relates to a thimble for inserting pins or other metallic members into a needlepoint form or other material with one hand while holding the material with the other hand. The closed end of the thimble has a small magnetic recess of any shape or size formed therein for receiving the pins. Alternatively, the closed end of the thimble can itself be magnetized.

The open end of the thimble, which fits over the thumb or finger, receives adapters of different inside dimensions for fitting various thumb or finger sizes.

Further, the thimble may comprise two shells operatively associated through a spring disposed between the two shells. When the outer shell, containing a pin to be inserted, is pressed against a pin receiving material, pressure is exerted on the inner shell by the thumb or finger and the pressure or force is transmitted to the outer shell and pin through the spring.

Accordingly, it is an object of this invention to provide a thimble having a magnetic recess formed in the closed end thereof.

Another object of the invention is to provide a thimble having a magnetic recess wherein the open end is adapted to receive adapters to fit thumbs or fingers of differnt dimensions.

Another object of the invention is to provide a thimble having a magnetic recess wherein the thimble comprises two shells operatively associated through a spring disposed between the two shells.

Another object of the invention is to provide a thimble wherein the entire closed end thereof is magnetized.

These and other objects and advantages of the invention are believed made clear by the following description thereof taken in conjunction with the accompanying drawings wherein.

IN THE DRAWINGS

FIG. 1 is a side elevation of the thimble.

FIG. 2 is a top view of the thimble.

FIG. 3 is an exploded view, partly in section, of the thimble and adapter.

FIG. 4 is a side elevation in section showing the spring loaded embodiment of the invention.

FIG. 5 is a side elevation in section showing the embodiment of the invention wherein the entire closed end is magnetized.

Referring now to FIGS. 1 and 2, there is shown a thimble 10 of standard shape and size having a circumferential flange 11 disposed around the bottom, open end 12 thereof and having a rounded closed end 13 all as is already known in the art.

A small recess 14 is formed in closed end 13 and is magnetized so that it may pick up the head of a metallic pin such as shown at 15 in FIG. 4.

A thumb or finger receiving means 16 is formed inside of thimble 10 so that the thimble may be securely held on a thumb or finger.

In operation, while one hand is holding and or stretching a piece of material to be pinned, the hand with the thimble having the magnetic recess can easily pick up a single metallic pin or another insertable member and push the pin into the material.

Referring now to FIG. 3 there is shown the thimble of FIGS. 1 and 2 and an adapter 17 which slidably fits into open end 12 of thimble 10. This adapter will have outside dimensions to fit snugly into open end 12 of the thimble and various inside dimensions to accommodate thumbs or fingers of various sizes. Obviously, the adapters will be of various sizes as regards its inside dimensions.

Referring to FIG. 4 there is shown a thimble 18 having an outer shell 19 and an inner shell 20 operatively associated with each other through means of a spring 21 disposed between the two shells. In this embodiment the magnetic recess 14 is formed in the top of inner shell 20 and an aperture 22 extends through the closed end 13 of outer shell 19 and aligns with magnetic recess 14. Obviously, the adapter 17 of FIG. 3 can also be used in conjunction with the embodiment shown in FIG. 4.

In operation of the embodiment disclosed in FIG. 4, a pin 15, made of metallic material, is picked up by means of the magnetic recess 14 and thumb pressure is applied to inner shell 20 when the pin is placed on some material. The thumb pressure or force is transmitted through spring 21 to outer shell 19 and the pin is thereby inserted.

Referring now to FIG. 5 there is shown the thimble 10 of FIG. 1 but wherein the closed end 13 is made of a magnetic material and the recess 14 is also magnetized.

In summary, what has been described above is a novel thimble having a small magnetic recess formed in the closed end thereof for easily picking up, holding and inserting a metallic pin into a material or form. Further, we have disclosed a thumb or finger adapter, to accommodate various size thumbs or fingers, which slidably fits into the open end of the thimble. Finally, another embodiment discloses a thimble comprising an outer shell and an inner shell with a spring operatively disposed between the two shells. An opening extends through the closed end of the outer shell and the opening aligns with a magnetic recess formed in the inner shell.

It will be understood that the invention is not to be limited to the specific construction or arrangement of the parts shown and that they may be modified widely within the invention defined by the claims.

What is claimed is:

1. A thimble comprising:

a. An outer shell;

b. An inner shell slidably disposed in said outer shell;

c. A spring operatively associated with said outer shell and said inner shell and disposed there between whereby when thumb pressure is applied to said inner shell, said pressure is transmitted through said spring to said outer shell;

d. A magnetic recess formed in the top of said inner shell for receiving a metallic pin; and, e. An aperature extending through a closed end of said outer shell and aligned with said magnetic recess whereby said metallic pin is received, held and inserted.

2. The thimble of claim 1 further comprising an adapter slidably insertable into said inner shell to accommodate thumbs or fingers of various sizes.

* * * * *